United States Patent [19]

Morioka

[11] 4,387,495

[45] Jun. 14, 1983

[54] METHOD AND APPARATUS FOR FEEDING CONDUCTIVE WIRE FOR ANODIZING PROCESS OF SLIDE FASTENER CHAIN

[75] Inventor: Koitsu Morioka, Kurobe, Japan

[73] Assignee: Yoshida Kogyo K.K., Tokyo, Japan

[21] Appl. No.: 286,476

[22] Filed: Jul. 24, 1981

[30] Foreign Application Priority Data

Sep. 25, 1980 [JP] Japan ..... 55-133477

[51] Int. Cl.[3] ..... B21F 45/18; A41H 37/06

[52] U.S. Cl. ..... 29/408; 29/769

[58] Field of Search ..... 29/766, 769, 408, 33.2; 72/336, 337; 425/819

[56] References Cited

U.S. PATENT DOCUMENTS

| | | | |
|---|---|---|---|
| 2,141,200 | 12/1938 | Sundback | 29/769 |
| 2,763,051 | 9/1956 | Firing | 72/336 |
| 2,989,444 | 6/1961 | Cohn | 204/23 |

*Primary Examiner*—Francis S. Husar
*Assistant Examiner*—Steven Nichols
*Attorney, Agent, or Firm*—Hill, Van Santen, Steadman, Chiara & Simpson

[57] ABSTRACT

Improved method and apparatus for feeding a conductive wire for anodizing process of a slide fastener chain are disclosed in which a wire guide member reciprocates perpendicularly to the feeding movement of the fastener tape so that the distance between the upper end of the guide member and the lastly secured fastener element decreases as the guide member moves from a position spaced from the beaded portion of the tape to a position close to the beaded portion, thereby giving appropriate slack to the wire. The fastener elements are secured to the beaded portion of the tape when the guide member is in the position close to the beaded edge. Therefore, possibility of breaking the wire is minimized.

6 Claims, 7 Drawing Figures

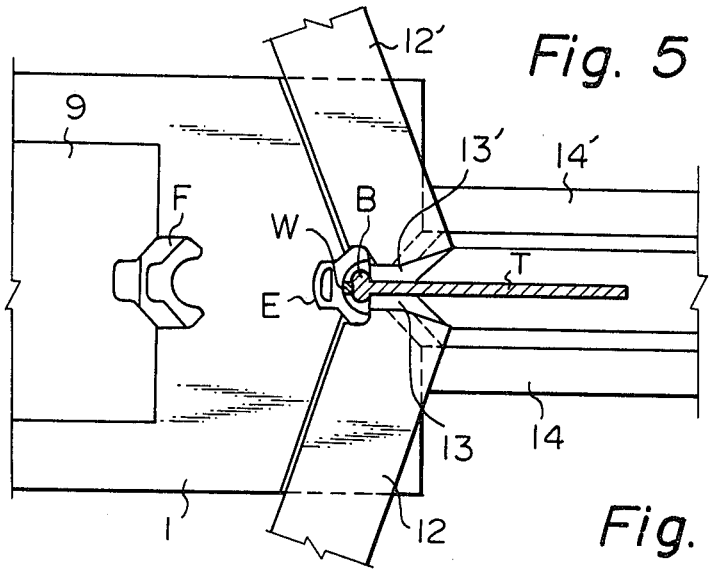
Fig. 5
Fig. 7
Fig. 6
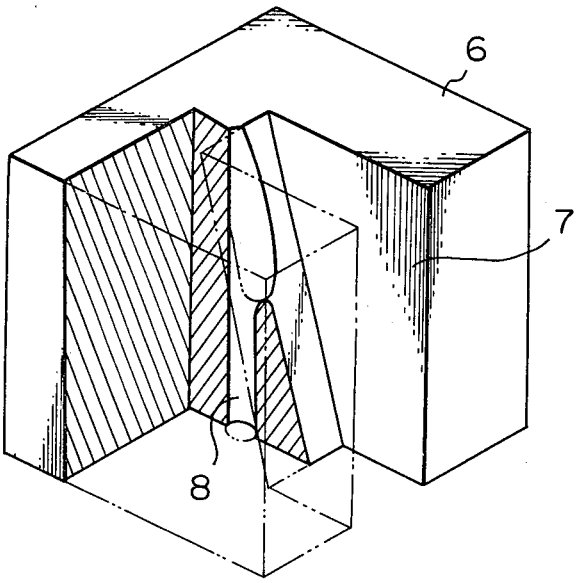
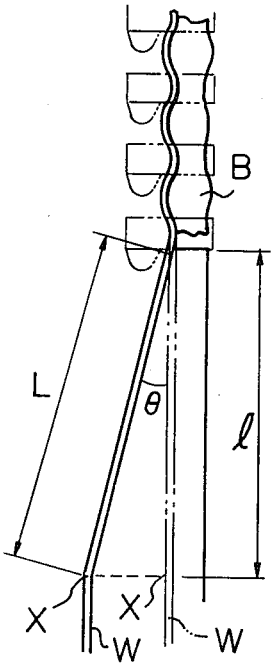

METHOD AND APPARATUS FOR FEEDING CONDUCTIVE WIRE FOR ANODIZING PROCESS OF SLIDE FASTENER CHAIN

BACKGROUND OF THE INVENTION

This invention relates to method and apparatus for feeding a conductive wire when a slide fastener chain provided with a conductive wire for anodizing process is produced. More particularly, the invention relates to improved method and apparatus by which a conductive wire can reliably be secured to the beaded portion of a slide fastener tape without breaking the wire.

Heretofore, U.S. Pat. No. 2,989,444 is known to show a device for feeding a conductive wire for anodizing process of a slide fastener chain. In this device, the wire is guided by a curved tubular fixed guide from a place spaced from the beaded portion of a fastener tape to a point adjacent the beaded portion, where it is secured to the beaded portion by an element to be fixed to the beaded portion. The device is adapted so that the conductive wire is advanced by rollers operating synchronously with the feeding movement of the tape. In such device, the portion of the conductive wire adjacent the beaded portion of the tape is a little tautened by frictional drag imparted from the curved tubular fixed guide. In this condition, when a fastener element is fixed to the beaded portion, the beaded portion deforms clamped by the legs of the element making the sections of the beaded portion between adjacent elements bulge. This results in increased tension in the portion of the wire extending between these elements and causes possibility of breaking the wire. A break in the wire also occurs when advancement of the tape and the wire is not completely synchronous. Furthermore, the drag imparted to the wire from the fixed guide as the wire is advanced increases the possibility of breaking the wire.

SUMMARY OF THE INVENTION

Therefore, it is an object of the invention to provide method and apparatus for feeding a conductive wire when a slide fastener chain provided with a conductive wire for anodizing process is produced, wherein the possibility of a break in the wire is minimized by providing appropriate slack in the portion of the wire adjacent the beaded portion of the fastener tape.

Another object of the invention is to provide method and apparatus for feeding a conductive wire, wherein the possibility of a break in the wire is minimized by reducing the drag imparted to the wire from means for guiding the wire.

According to the invention, a wire guide block reciprocates between a position adjacent the beaded portion of a tape and a position spaced therefrom. The distance between the upper end of a wire guide hole of the wire guide block and a lastly secured fastener element decreases as the wire guide block moves from the position spaced from the beaded portion of the tape to the position adjacent the beaded portion, thereby providing a slack in the conductive wire. Furthermore, the wire is so guided that it extends parallel with the feeding direction of the tape when the wire guide block is in the position adjacent the beaded portion of the tape and while this condition is kept the wire is fed concomitantly with the movement of the tape. Therefore, the wire guide hole causes little drag on the movement of the wire.

BRIEF DESCRIPTION OF THE DRAWINGS

The above mentioned and other objects and features of the invention will be clear from the following description referring to the drawings, wherein:

FIG. 5 is a plan view of a portion of the apparatus shown in FIG. 2 showing a way of squeezing the legs of a fastener element onto the beaded portion of the tape;

FIG. 6 is a perspective view of the wire guide block used in the apparatus of FIG. 2 with a portion being removed for clearly showing a wire guide hole therein; and FIG. 7 is a schematic illustration showing the relation between the beaded portion of a fastener tape and a conductive wire in two different positions of the wire.

DESCRIPTION OF THE PREFERRED EMBODIMENTS

Figure 2:
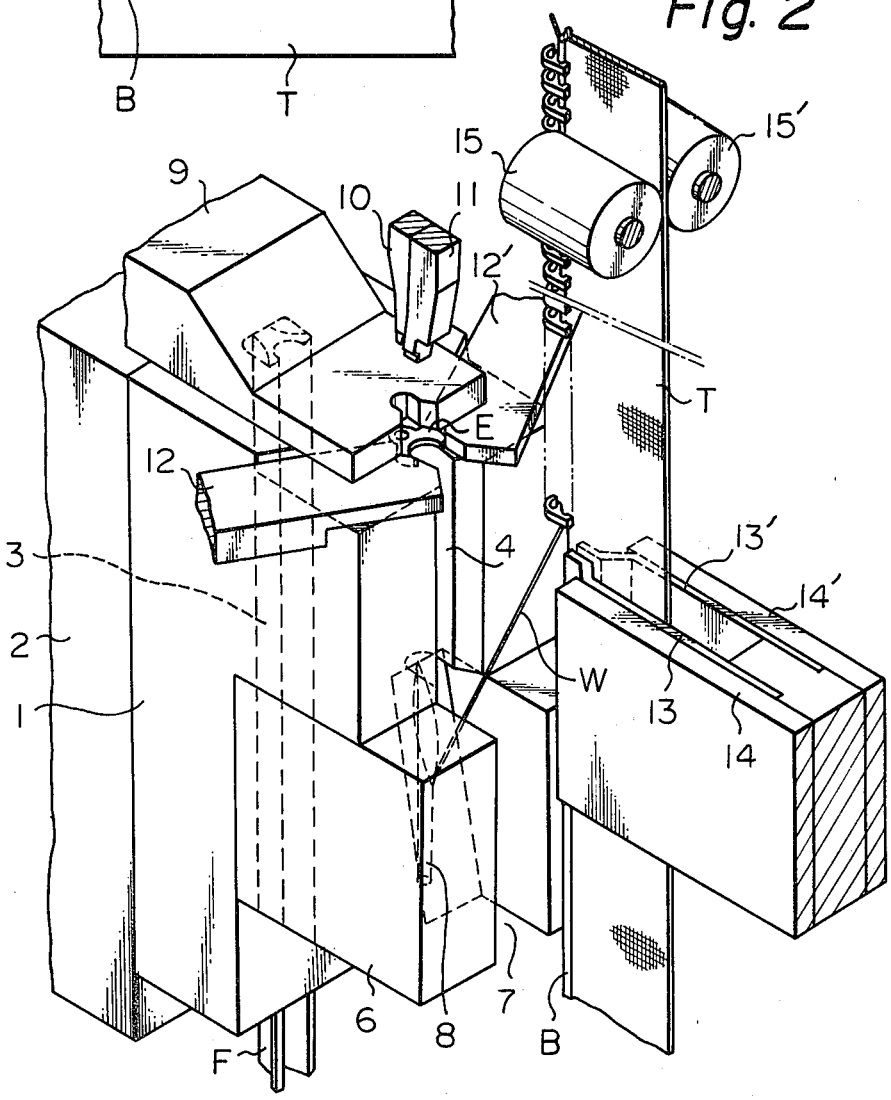
FIG. 2 is a perspective view of an apparatus for securing fastener elements to the beaded portion of a fastener tape in which a wire feeding device according to one embodiment of this invention is incorporated.

With reference to FIG. 2, numeral 1 indicates an element forming die generally having the shape of inverted "L". The die is secured to the forward end of a main ram 2 which is horizontally reciprocated by suitable driving means (not shown). The element forming die 1 has a passage 3 extending vertically therethrough around the center of the die so that a formed wire F is fed through the passage. The element forming die 1 has a tape guide channel 4 formed in the front side thereof for guiding a slide fastener tape T. The forming die 1 is also provided with a head die portion 5 (FIGS. 3 and 4) at the forward end on the upper surface and adjacent the upper end of the guide channel 4.

A wire guide block 6 is secured to the forming die 1 at the lower portion thereof. The wire guide block 6 is formed with a channel 7 having a slant bottom wall in the center of the front side thereof. A conductive wire guide hole 8 for guiding a conductive wire W for anodization process is formed in the wire guide block 6 so that the hole opens at the bottom wall of the channel 7 and communicates with the tape guide channel 4. The opening of the guide hole 8 extends from the middle portion to the upper portion of the bottom of the channel 7.

Above the element forming die 1, a cutting punch 9 for cutting the formed wire F is fixedly connected to a frame or the like (not shown). The cutting punch 9 may be made movable. However, in any case, the cutting punch must be adapted to provide relative movement in horizontal direction with respect to the element forming die 1 when the latter horizontally moves. In front of this cutting punch 9, a vertically movable head forming punch 10 and a pressure pad 11 for holding a fastener element E during head forming operation are provided in a juxtaposed relation. In front of the cutting punch 9, there are also provided side punches 12 and 12' mounted on opposite sides of the tape guide channel 4 for reciprocation in generally lateral direction for squeezing the legs of the fastener element E.

A conductive wire W is passed through the wire guide hole 8 and secured to the beaded portion B of the tape T by the fastener elements E successively fixed to the beaded portion.

Tape guides 13 and 13' for guiding the slide fastener tape T are provided in front of the element forming die 1 and stoppers 14 and 14' are placed on the outer sides of the tape guides, respectively, to limit the forward movement of the element forming die 1 and to register the same. Feed rollers 15 and 15' (FIG. 2) for drawing the tape T upward are placed above the stoppers. The feeding direction and the orientation of the tape T are such that the wire guide block reciprocates perpendicularly to the feeding movement of the tape T in the plane including the tape. Numeral 16 (FIGS. 3 and 4) indicates feed rollers for feeding the formed wire F.

Figure 1:
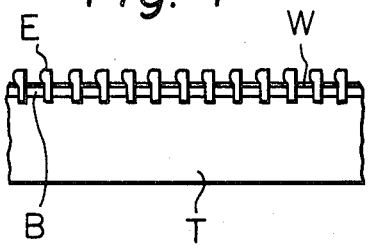
FIG. 1 is a plan view of a slide fastener stringer provided with a conductive wire for anodizing process.

In operation, the formed wire F is upwardly fed by the amount corresponding to the thickness of one element E when the element forming die 1 is in its advanced position in which the cutting punch 9 does not interfere with the upward movement of the formed wire F. When the element forming die 1 retracts from the forward position shown in FIG. 4 to the backward position shown in FIG. 3, the formed wire F is cut by the cutting punch 9 to form a blank of an element E. When the element forming die 1 reaches its backward position, the head die portion 5 aligns with the head forming punch 10 and receives the cut blank of the element E. Then the head forming punch 10 and the pressure pad 11 descend to form the head of the element E and then the element forming die 1 starts forward movement. In the forward position of the element forming die 1 shown in FIG. 4, the legs of the element formed with the head receive the beaded portion B of the tape T therebetween. Then, the side punches 12 and 12' are driven to squeeze the legs of the element. By these steps, the element E are fixed to the beaded portion B together with the conductive wire W to form a fastener chain provided with a conductive wire for anodizing process as shown in FIG. 1. After the last mentioned step finishes, side punches 12 and 12' retreat and the tape T is advanced by one pitch and upwardly pulls the wire W.

The wire guide hole 8 in the wire guide block 6 is so positioned that the wire W guided by the hole 8 extends parallel with the feeding direction of the tape T and the wire portion adjacent the lastly secured element is brought into close contact with the beaded portion B when the element forming die 1 and the guide block 6 secured thereto are in their forward position. In other words, the guide hole 8 aligns with the direction of the wire movement. Therefore, the wire W can be pulled by the tape T with little drag from the guide hole 8. Therefore, the possibility of a break in the wire W is decreased. Furthermore, close contact between the wire W and the beaded portion B when the element E is secured to the beaded portion also reduces possibility of wire break. Furthermore, since feeding means for the wire W is unnecessary, there is no possibility of a break in the wire due to mis-synchronization between the operation of the wire feeding means and the tape movement.

Figure 3:
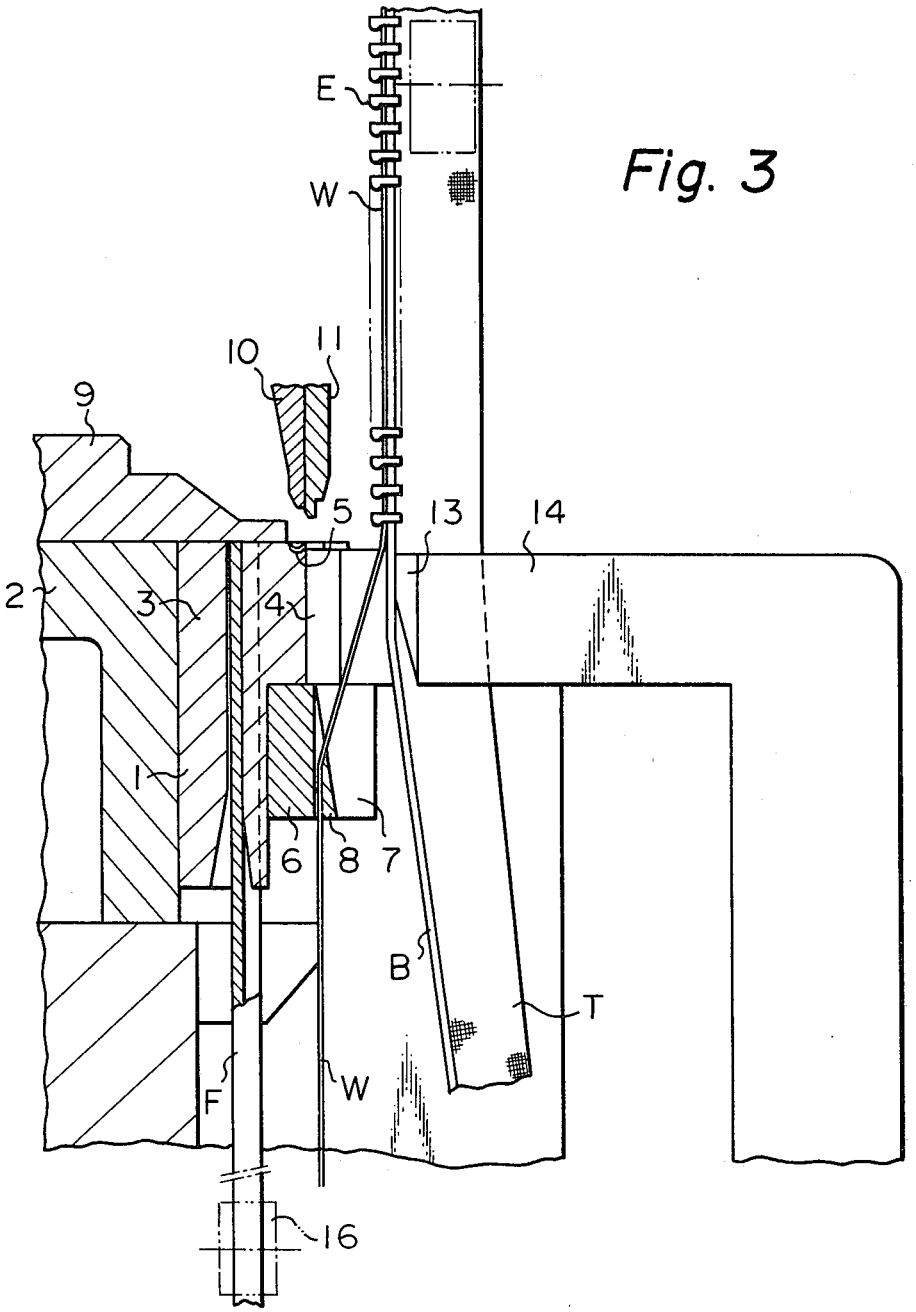
FIG. 3 is a sectional view of the apparatus of FIG. 2 showing the condition in which a wire guide block is spaced from the fastener tape.
Figure 4:
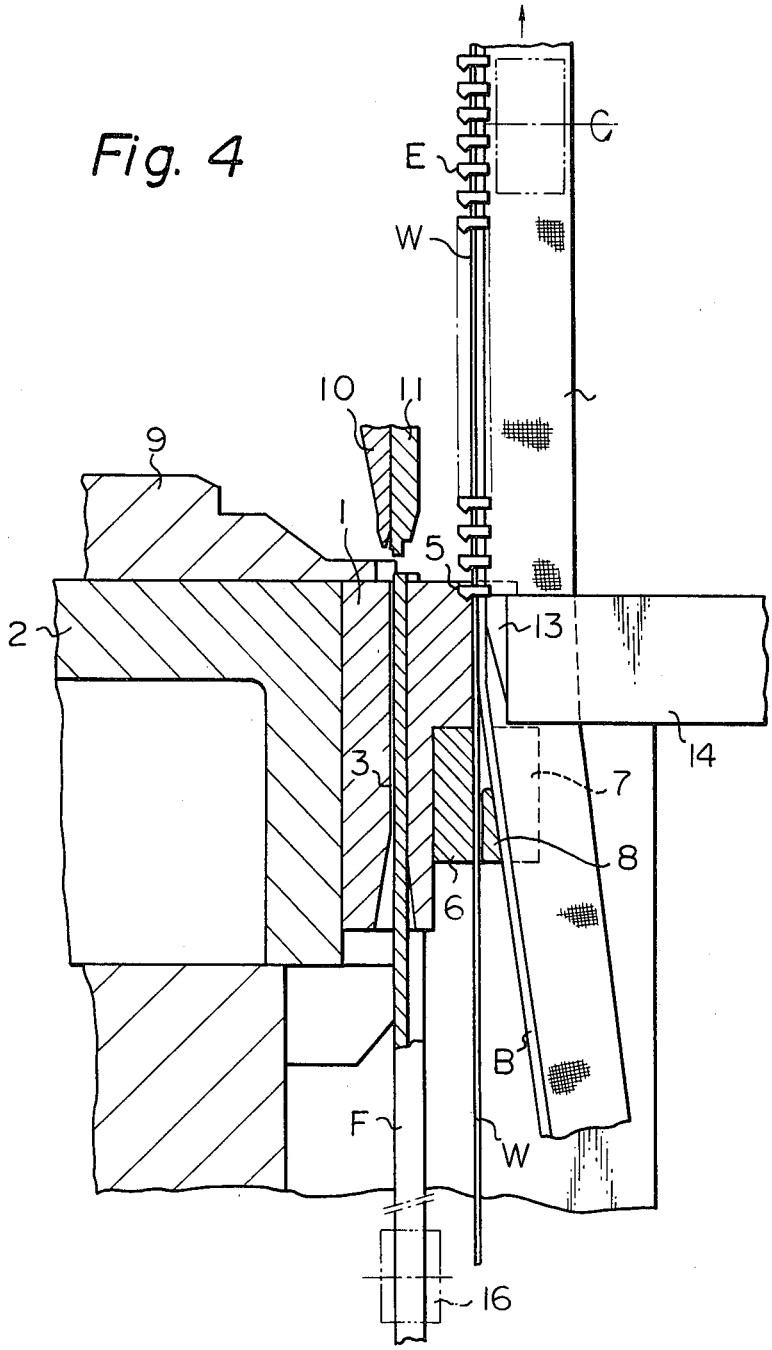
FIG. 4 is a sectional view of the apparatus of FIG. 2 showing the condition in which the wire guide block is adjacent the tape.

The wire guide block 6 in this invention reciprocates perpendicularly to the feeding movement of the tape T in forward and backward directions toward and away from the tape T as illustrated by FIGS. 3 and 4. Accordingly, the portion of the wire between the upper end of the wire guide hole 8 and the lastly secured element E swings by angle $\theta$ as shown in FIG. 7. As is clear from this drawing, $$l = L \cdot \cos\theta$$

wherein l and L are distances between the upper end X of the wire guide hole 8 and the lastly secured element E in the forward and the backward positions of the wire guide block 6, respectively. Therefore, when the wire guide block 6 moves from the backward position to the forward position, the wire slackens by the degree corresponding to $L(1-\cos\theta)$. As those skilled in the art will appreciate, the wire W is thin, lightweight, and very flexible in the conventional manner. Thus, forces of gravity and wire rigidity are not sufficient to cause the wire to retract through the hole 8 during the rapid reciprocable movement of the guide block 6. By this slack, the wire is not subjected to substantial tension when the lowermost section of the beaded portion B between adjacent element E, upon being clamped by the legs of the elements E, is bulgingly deformed. The reciprocal movement of the guide block 6 also functions to position the wire on the center of the beaded portion. That is, since the portion of the wire between the upper end X of the wire guide hole 8 and the element E is moved away from the beaded portion B each time after the element is fixed to the beaded portion, the wire portion is accurately positioned at the center of the beaded portion B when it is brought into contact therewith by the forward movement of the guide block 6.

What is claimed is:

1. A method of feeding a conductive wire for anodizing process of a slide fastener chain in a system in which the wire is mounted on the beaded portion of the fastener tape by fastener elements successively fixed to the beaded portion, the method comprising: providing a wire guide member movable perpendicularly to the feeding movement of the fastener tape; passing the conductive wire through said guide member so that it is guided by the wire guide member before it is secured to said beaded portion of the tape; reciprocating said guide member between a first position in which the wire portion adjacent the lastly secured elements is in contact with the beaded portion of the tape and extends parallel with the feeding direction of the tape and a second position in which said wire portion angularly extends away from the beaded portion; and fixing a fastener element together with the wire to said beaded portion and feeding the tape thereafter when said wire guide member is in its first position.

2. A method of feeding a conductive wire for anodizing process of a slide fastener chain according to claim 1 in which said wire guide member reciprocates in the plane including the fastener tape.

3. An apparatus for feeding a conductive wire for anodizing process of a slide fastener chain in a system in which the wire is mounted on the beaded portion of the fastener tape by fastener elements successively fixed to the beaded portion, the apparatus comprising: a wire guide member having a wire guide hole through which said wire extends, means for reciprocating said wire guide member between a first position in which the wire portion adjacent the lastly secured element is in contact with the beaded portion of the tape and extends parallel with the feeding direction of the tape and a second position in which said wire portion angularly extends away from the beaded portion; and means for securing the fastener elements successively to the beaded portion of the tape together with said wire when said wire guide member is in its first position.

4. An apparatus for feeding a conductive wire for anodizing process of a slide fastener chain according to claim 3 in which said wire guide hole extends parallel with the feeding direction of the fastener tape when said wire guide member is in its first position.

5. An apparatus for feeding a conductive wire for anodizing process of a slide fastener chain according to claim 3 in which said means for securing the fastener elements includes an element forming die movable perpendicularly to the feeding direction of the tape between a first position in which a fastener element supported on the element forming die receives the beaded portion of the tape between the legs thereof and a second portion spaced from the beaded portion wherein a fastener element is formed, said element forming die being adapted to cut out fastener elements as it moves from the first position and the second position in cooperation with a cutting punch, said wire guide member being secured to the element forming die.

6. An apparatus for feeding a conductive wire for anodizing process of a slide fastener chain according to claim 3, 4 or 5 in which said wire guide member reciprocates in the plane including the tape.

* * * * *